United States Patent [19]

Johnson

[11] 4,180,004

[45] Dec. 25, 1979

[54] METHODS OF HANDLING WASTE INCLUDING RUBBER TIRES

[75] Inventor: Albert O. Johnson, Livingston, Tex.

[73] Assignee: Tire-Gator, Inc., Houston, Tex.

[21] Appl. No.: 882,449

[22] Filed: Mar. 1, 1978

Related U.S. Application Data

[62] Division of Ser. No. 770,002, Feb. 18, 1977.

[51] Int. Cl.[2] ..... F23G 7/00

[52] U.S. Cl. ..... 110/346; 44/1 D; 110/222

[58] Field of Search ..... 44/1 D; 241/29; 110/222, 346

[56] References Cited

U.S. PATENT DOCUMENTS

| | | | |
|---|---|---|---|
| 3,506,414 | 4/1970 | Skendrovic | 110/222 |
| 3,685,467 | 8/1972 | Morrill | 110/222 |
| 3,946,680 | 3/1976 | Laman | 110/346 |
| 4,081,143 | 3/1978 | Johnson et al. | 241/29 |

FOREIGN PATENT DOCUMENTS

| | | | |
|---|---|---|---|
| 2511477 | 9/1976 | Fed. Rep. of Germany | 44/1 D |

*Primary Examiner*—Kenneth W. Sprague
*Attorney, Agent, or Firm*—Laurence R. Brown

[57] ABSTRACT

Waste such as combustible trash and prime garbage is mixed with rubber tires and shredded together to produce a compacted and combustible output product which can be used as a fuel or be incinerated for further compacting.

The process involves interengaging rotary feeder-cutter wheels mounted on counterrotating shafts to pull materials through a feed path while shredding with the aid of shredder blades interspersed between the wheels. Feeding, mixing and conveying techniques through one or more shredder stages provide for attainment of high speed feed rates and handling of some degree solid debris such as steel belts in tires.

8 Claims, 8 Drawing Figures

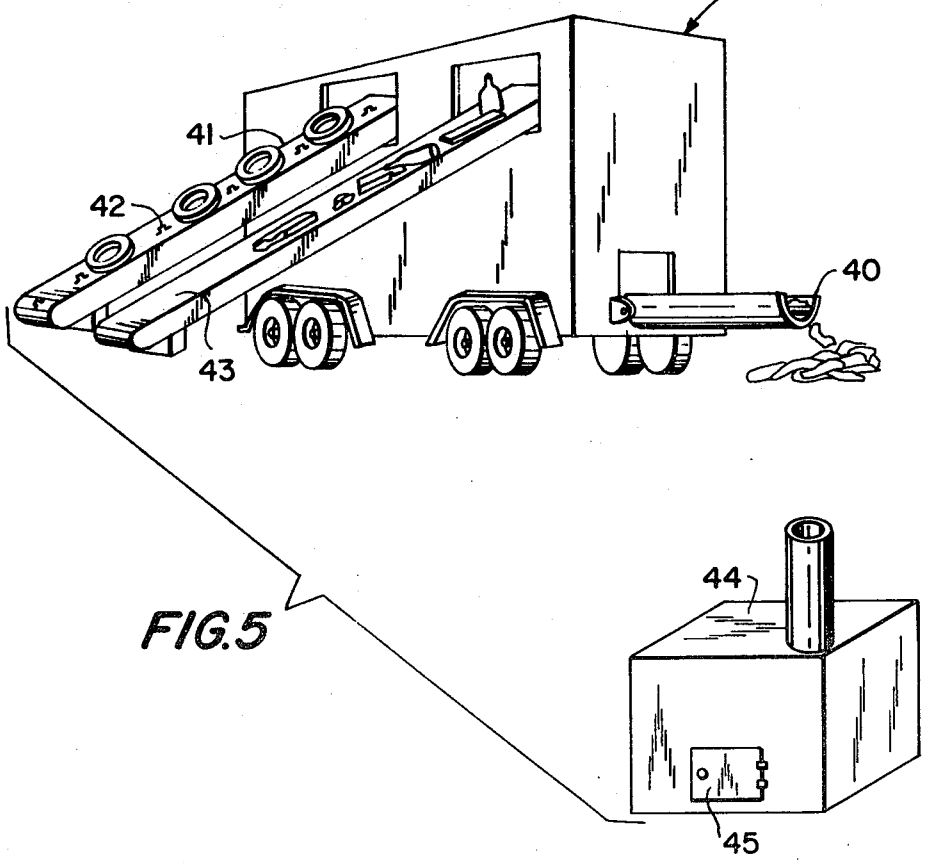
FIG. 5
FIG. 6
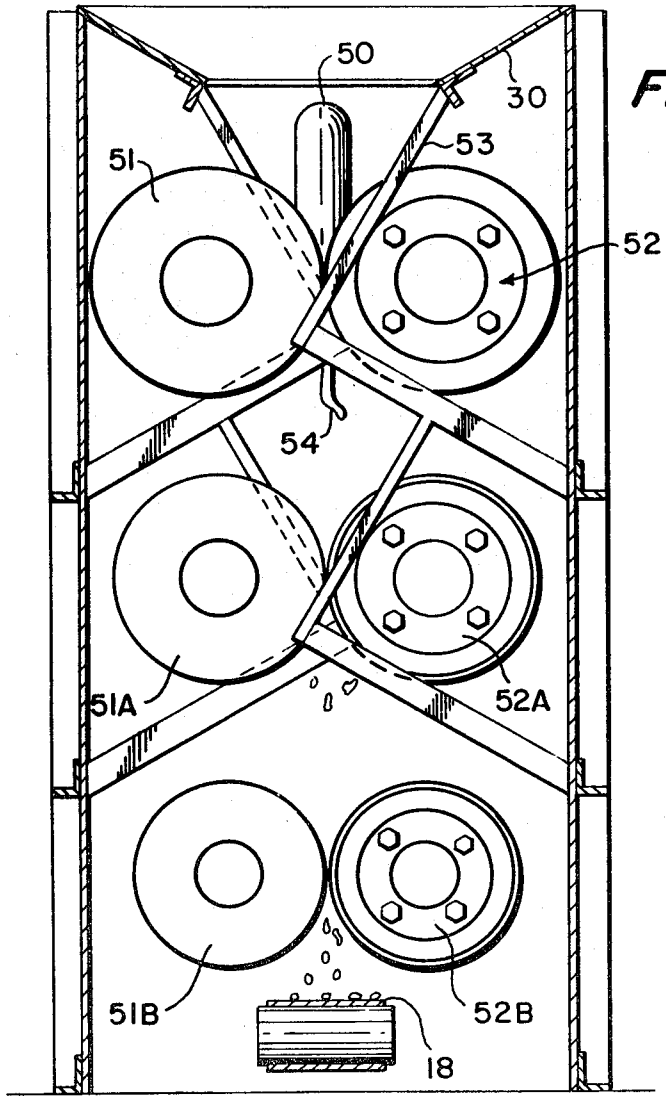

METHODS OF HANDLING WASTE INCLUDING RUBBER TIRES

This is a divisional case of U.S. Ser. No. 770,002 filed Feb. 18, 1977 and constitutes a continuation-in-part of the divisional subject matter.

This invention relates to waste compacting and more specifically it relates to mixing of shredded materials including rubber tires as a combustible fuel.

BACKGROUND OF THE INVENTION

Disposal of waste in urban areas has increasingly become a problem. Because of modern packages, mixture of trash and garbage from various foods and accumulation of such non-compactible trash as rubber tires special problems are introduced in disposal. Squeezing compactors in collection trucks are not adopted to handle tires and other substantially non-compressible materials, and although they improve packing efficiency of raw trash, they still inefficiently transport bulk trash over long distances to incinerator sites or dumps.

Conservation of energy is a concurrent problem in urban areas. Little of the combustible waste is used for useful fuel. The raw form in which combustibles are found is not generally adaptable to ready use as a fuel source. Papers, cardboard and plastic materials need be conformed in shape and density for efficient fuel use and mixtures therewith of damp waste such as garbage generally reduces the possibility of getting heat energy from the run-of-the-mill waste. Many incinerating plants require input of fuel for handling such waste. Also, the damp waste and garbage mixed with trash tends both to accumulate in conveyors and to spoil thereby causing problems both of sanitation and fouling of equipment.

OBJECTS OF THE INVENTION

It is therefore a general object of the invention to provide improved methods of handling waste including rubber tires.

A more specific object of the invention is to compact a wide variety of intermixed waste materials by shredding and transporting it or incinerating it in shredded form.

A still more specific object of the invention is to produce combustible waste materials useful for fuel by shredding together rubber tires with garbage, combustible trash and the like.

BRIEF DESCRIPTION OF THE INVENTION

This invention provides methods of compacting disposable waste materials including rubber tires and garbage by shredding and intermixing to produce a combustible mixture which can be efficiently transported, incinerated or used as a fuel.

The shredding process involves pulling materials of varying texture through interengaging feed wheels spaced on counter-rotating parallel shafts to encounter sets of shredder blades disposed at a predetermined variable angle depending upon the texture of the waste. A series of shredder stages with different structure progressively shred the materials. Optimum mixture of diverse materials is attained to achieve a suitable output fuel product. For example, tires on one automated variable speed conveyor are mixed with trash and garbage on another variable speed conveyor to produce an optimum mix of tire and waste shreds for incineration or fuel purposes.

THE DRAWING

Other features, objects and advantages of the invention will be found hereinafter with reference to the accompanying drawing, wherein:

FIG. 5 is a diagrammatic view of a portable shredder assembly for processing and discharging two diverse kinds of waste materials including rubber tires;

FIG. 6 shows a multiple stage shredder assembly;

DETAILED DESCRIPTION OF THE INVENTION

Figure 1:
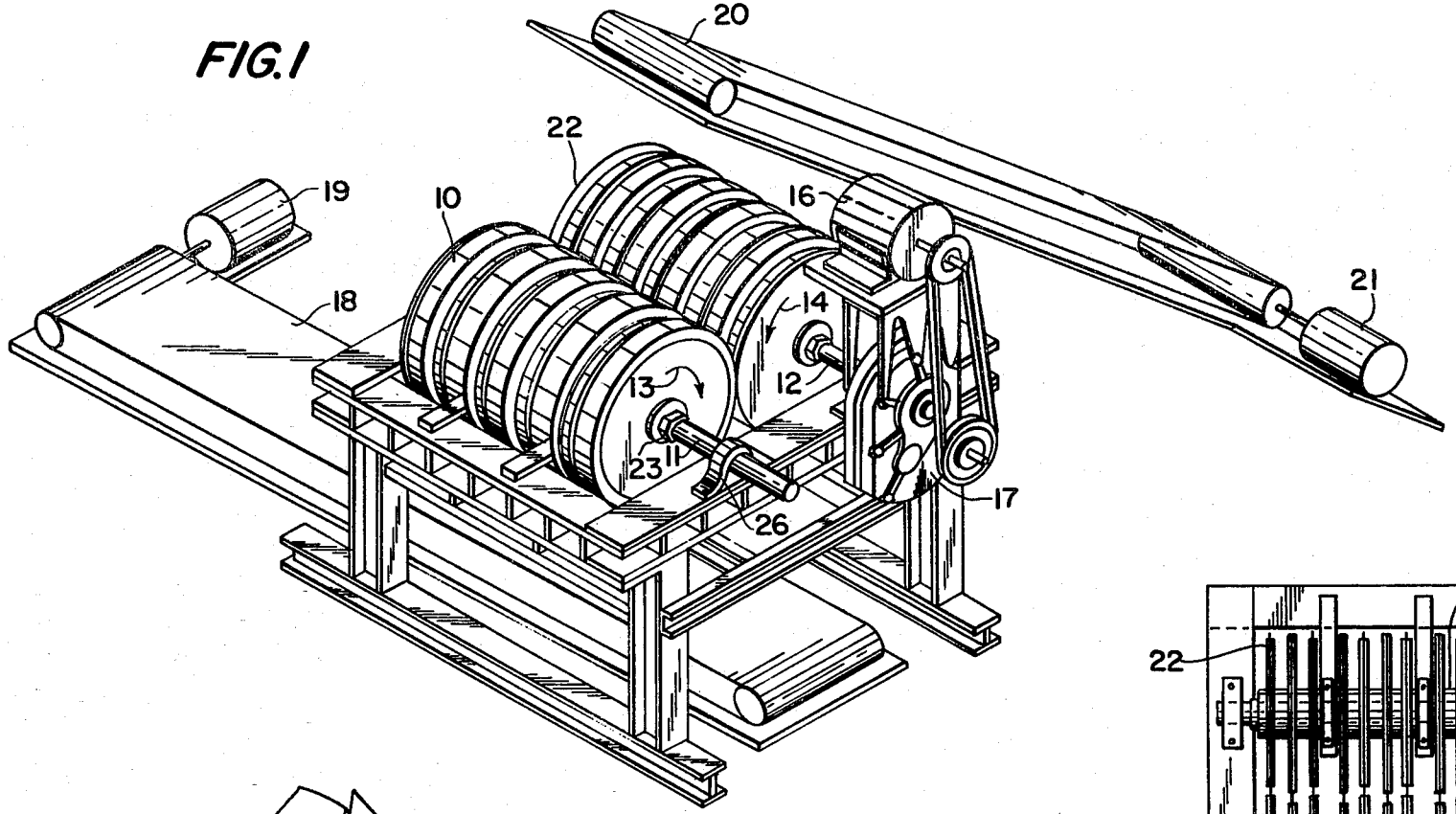
FIG. 1 is a perspective view of a one stage shredder assembly shown without conveyor housing details in order to set forth the feed flow path of materials therethrough.
Figure 2:
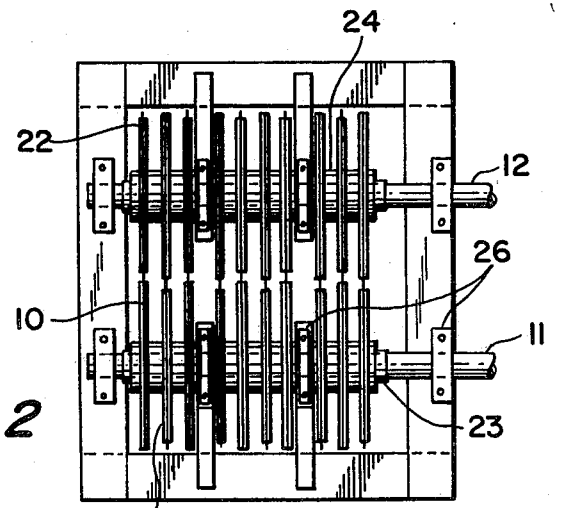
FIG. 2 is a plan view of the relationship of the shredder feed wheels as mounted on two counter-rotating parallel shafts.

Now with general reference to the perspective view of FIG. 1 and corresponding plan view of the shaft wheel assembly in FIG. 2, a single shredder stage is shown with some details removed such as shredder plates, feeding teeth, housing, etc. so that the general operation and assembly of the shredder may be more readily visualized.

For shredding automobile size rubber tires for example, the sets of wheels 10 have a thirty inch (0.762 cm) diameter wheels spaced on 3½ inch (8.89 cm) center lines on 4 inch (10.16 cm) diameter pulley shafts 11, 12 counter-rotated as shown by arrows 13, 14 by means of 15 HP drive motor 16 as reduced by belt-pulley changes and/or a variable speed drive gear reduction box 17 to revolve at speeds in the range of 15 to 50 RPM to thereby feed downwardly onto conveyor belt 18, preferably driven by a variable speed motor 19. To feed materials into the shredder stage, a feed-in conveyor belt 20 is driven by a variable speed motor 21. Speed controls are not shown, but the variable speed feature gives optional choice for the rate of conveying input and output materials into and out of the shredder mechanism in the manner to be hereinafter set forth.

As may be seen best from FIG. 2, the wheels 10, 22 are respectively anvil and cutter blades in contact with each other and they are alternatively positioned along each of the shafts 11, 12 to thereby provide a feed direction downwardly as shown in FIG. 1, by means of both the circumference and sides of the wheels. That is the materials feed downwardly through the gaps between the wheels in strips or shreds to arrive on conveyor belt 18 for transport to a remote position such as a storage bin, truck or further conveyor system. The anvil wheels 10 are made of SSS100 steel alloy, and the cutter blades are made of Rockwell 49 tool steel, preferably in three 120° sectors mounted between two opposed faceplates of said steel alloy, so that any damaged blades may be readily replaced without disassembly of the entire shaft. For this purpose blade parts and spacers 24 are held on the shafts by friction from nuts 23, and may be keyed to prevent slipping if desired. Suitable shaft bearings 26 are used as shown.

Figure 4:
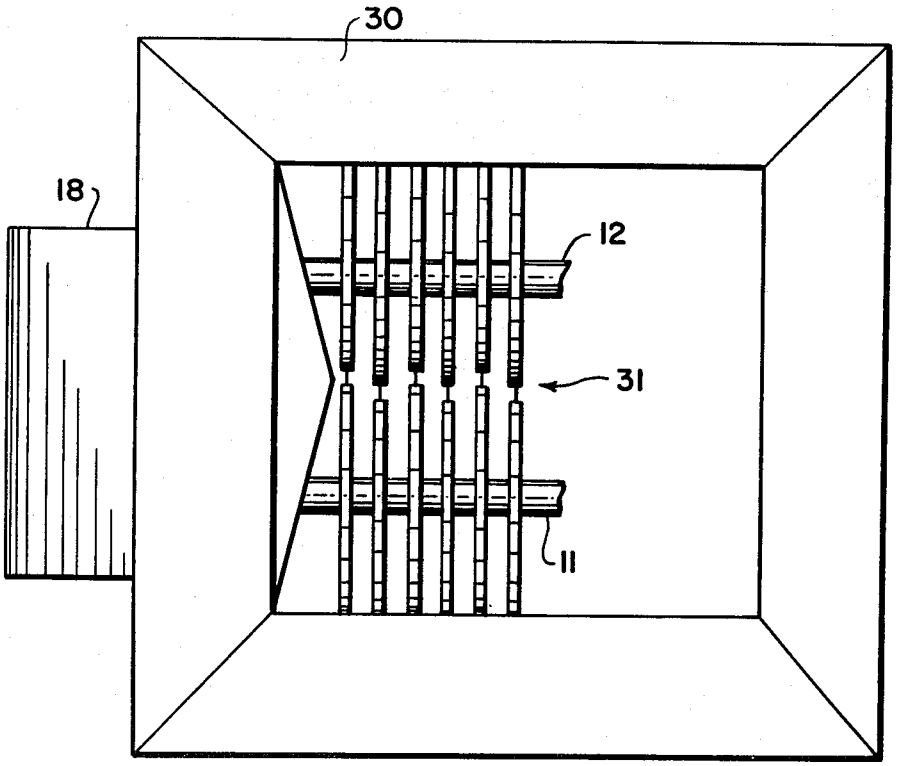
FIGS. 3 and 4 are respectively top and side views of a storage hopper, gravity feed assembly for guiding waste materials into the shredder feed wheels.
Figure 3:
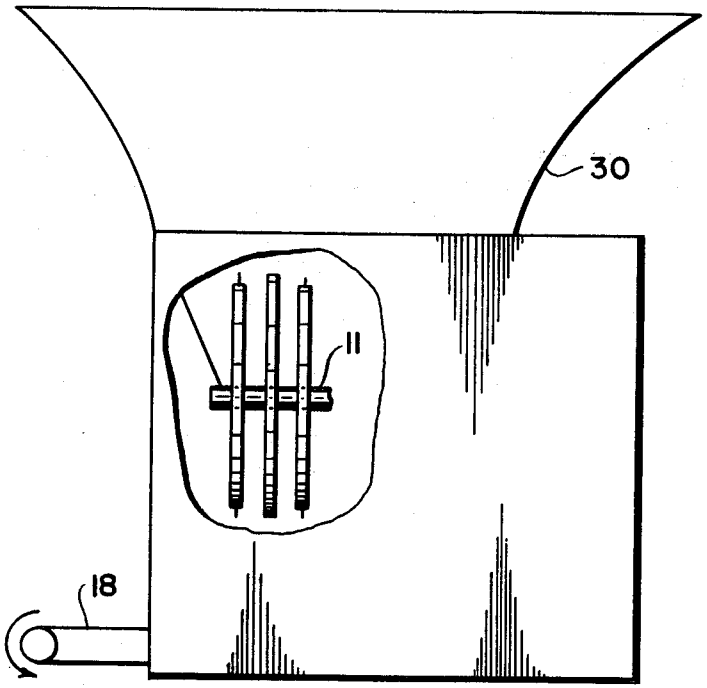

As may be seen from FIGS. 3 and 4 a feed hopper assembly 30 acts as a storage bin for receiving and mixing input materials to be shredded and feeding them into the counterrotating feed wheel assembly 31. These wheels process various types of materials to shred them and feed them downwardly so that they may be fed in shredded form out on conveyor belt. By friction action of the wheels both at the contact surfaces and on side of the wheel surfaces, materials fed thereinto will be dragged through the feed wheel knives and shredding members (not shown in this view) and emerge in reduced size dimensions.

So that all forms of waste including truck tires may be fed and intermixed into the feed and shredding wheel assembly 31 the upper dimensions of the feed hopper are 7 ft. 7½ inches (232.41 cm) by 8 ft. 1½ inches (247.65 cm) and the depth of the tapered side panels is 2 ft. 6 inches (76.2 cm), to feed a set of 30 inch (76.2 cm) diameter wheels spaced 3½ inches (8.89 cm) apart on 4 inch (10.16 cm) counterrotating shafts 11, 12.

Through this assembly when constructed in accordance with the teachings of this invention, a wide variety of materials can be shredded including 2×4 lumber beams, wet, oily steel belted truck tires and miscellaneous kinds of items generally found in trash and waste. As will hereinafter be noted, depending upon the mix and character of materials processed, different feed speeds may be employed, and certain features are provided for better handling materials of different texture over a wide range such as cardboard, tree limbs, tires, carcasses, etc.

As seen from FIG. 5, the shredder techniques afforded by this invention are adaptable to a portable unit 39 that can be moved from place to place by a conventional trailer hitch for example and perform on-site shredding of a variety of materials. The output shredded materials by way of output conveyor 40, which may be of the screw conveyor type either pipe style or half cylindrical as shown, is able to load shredded materials on trucks or other conveying equipment. Of course, an adequate electrical power source should be available for electric motor drive or equivalent gasoline engine belt drive equipment be supplied, in such portable unit.

This embodiment of FIG. 5 also exemplifies the handling efficiencies that can come from separation of input materials of diverse characteristics. Thus, rubber tires are conveyed on conveyor belt 41 which preferably has cogs 42 for gripping tire carcasses for positive conveyance up steep belt slopes. The drive mechanism for belts 41 and 43 are separate and of variable speed. Thus, when trash or garbage for example is processed on belt 43, it can be fed at a different rate, generally of greater volume throughput than the tires. If the material is garbage for example to be used as a fuel or otherwise incinerated, the tires can be mixed in proper proportions to give the desired fuel mixture. Both belts feed materials into a storage hopper as shown in FIGS. 3, 4 for processing through the shredder wheel assembly such as shown in FIG. 1, all mounted inside the housing of portable unit 39. Thus, shredding can occur if desired at a collection site and transported as compacted waste. It is clear that the feeding of the tires and trash through the shredder facility will produce an output product material much more readily compacted in a smaller space either for conveyance, storage, or dumping ground, than would be possible with the usual compression mechanisms used in waste disposal systems.

This portable unit 39 is particularly adapted to operate at an incinerator site where output conveyor 40 feeds the materials into the incinerator 44. This leaves only ashes removable by access door 45 that in general reduces and compacts the trash to its smallest volume form. When the rubber tires are properly mixed into the trash and shredded they can serve as the sole source of fuel for incineration, thus providing an efficient and economical trash disposal process. Under conditions where combustible materials such as waste paper, garbage, etc. are processed, there can be such efficient combustion even with damp garbage or other wet waste, that excess heat produced in the incineration can be used for other purposes such as steam generation or processing of industrial processes.

When processing large throughput volumes, or when necessitating finer shreds in the output product, several shredder stages may be coupled in series along the feed path as shown in FIG. 6. Thus, preferably each succeeding stage has smaller diameter wheels more closely spaced together, and the last stage has only the wheels without the shredder members 53.

For a shredder system handling a wide range of waste intermixed with rubber tires of various size including truck tires, the three stages would typically have the respective following dimensions:

51, 52 wheel diameter 40 inches (101.6 cm) spaced 6 inches (15.24 cm) apart on 6 inch (15.24 cm) diameter shafts;

51A, 52A wheel diameter 30 inches (76.2 cm) spaced 3½ inches (8.89 cm) apart on 4 inch (10.16 cm) diameter shafts; and

51B, 52B wheel diameter 20 inches (50.8 cm) spaced 2½ inches (6.35 cm) apart on 4 inch (10.16 cm) diameter shafts.

Special problems are created in handling damp waste and rubber tires. If tire carcasses are wet and oily, they are both difficult to feed and to shred. Also, steel belts on tires need be shredded and discharged. Garbage and wet fibers such as rags tends to accumulate and clog spaces between wheels and in general the feed chutes of the shredder mechanism. It is therefore particularly advantageous to process rubber tires intermixed with garbage and damp waste for several reasons. Tire carcasses cannot be handled properly in waste disposal or compacted and present a major waste disposal problem. This process and system uses such carcasses to particular advantage. Intermixing of tires in the shredder provides the various advantages of (1) self-cleaning and polishing of the system, (2) producing an output shredded product that is easily conveyed in compacted form, and (3) produces a combustible self-fueled output product that is readily incinerated for further compacting or for producing heat energy.

Figure 7:
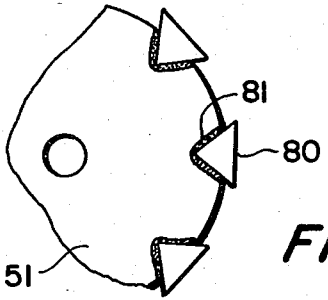
FIG. 7 shows details of conveying structure teeth attached to the feed wheels.

Therefore, to handle a wide range of materials including wet and oily steel belted truck tires, intermixed with garbage and bottles and baling wire and lumber or branches of trees and cans and metal cabinets and other items generally encountered in waste disposal, the feed wheels are preferably constructed as shown in FIG. 7.

As may be visualized by looking downwardly into the feed path of the plan view of FIG. 2, the positive feed through of materials is in part aided by the clamping between wheel knives and anvils, and partly impeded by encountering the shredding members. The wheels also function as frictional pullers on their sides giving additional impetus and force to the feeding of materials through the feed path. However, for exceptional items including oily steel belted truck tires this may not produce sufficient conveyance traction, or produce shredding of the steel belts. Also, occasionally the feed wheels may become blocked by entry of a piece of heavy steel for example. Thus, it is desirable to provide de-clogging means.

These problems are resolved by the features shown in FIG. 7. Thus, triangular teeth 80 are welded 81 onto at least one side of at least the anvil wheels 51. These teeth are made of ¼ inch (0.635 cm) automobile spring steel and on a 30 inch (76.2 cm) diameter wheel, extend 1 inch (2.54 cm) into the radial direction and 1 inch (2.54 cm) outside the wheel circumference with a 7 inch (17.78 cm) spacing between teeth apices along the circumference of the wheel 51.

Such construction gives better feeding, shredding and throughput capabilities over a wider range of material textures, but additionally give enough traction to de-clog a stalled mechanism simply by reversing the drive motors.

Several factors of this invention make it feasible to burn waste as a fuel producing thereby excess energy for use in heating water, etc., or in the alternative to incinerate waste without substantial external energy to reduce its volume by compacting to ash.

Consider the fact that wet garbage may be shredded and homogenously mixed with paper and tire shreds in a proportion to sustain self ignition for complete incineration even in the presence of usual amounts of moisture encountered in either primary waste from households, including garbage in the form of vegetation and kitchen waste or the conditions encountered in secondary commercial waste.

Also consider the fact that rubber tires are a problem in disposal and take up too much room to be handled or compacted because of their hollow nature. Further, fuel sources such as papers, boxes and tires are wasted in the absence of a practical process such as afforded by this invention, even at a time where fuel conservation is critical. Also, the fuel wasted in transportation of bulky waste to remote areas is an inefficiency corrected by this invention where the objective might be to remove the waste from an urban neighborhood in compacted form requiring little transportation cost or storage space.

Figure 8:
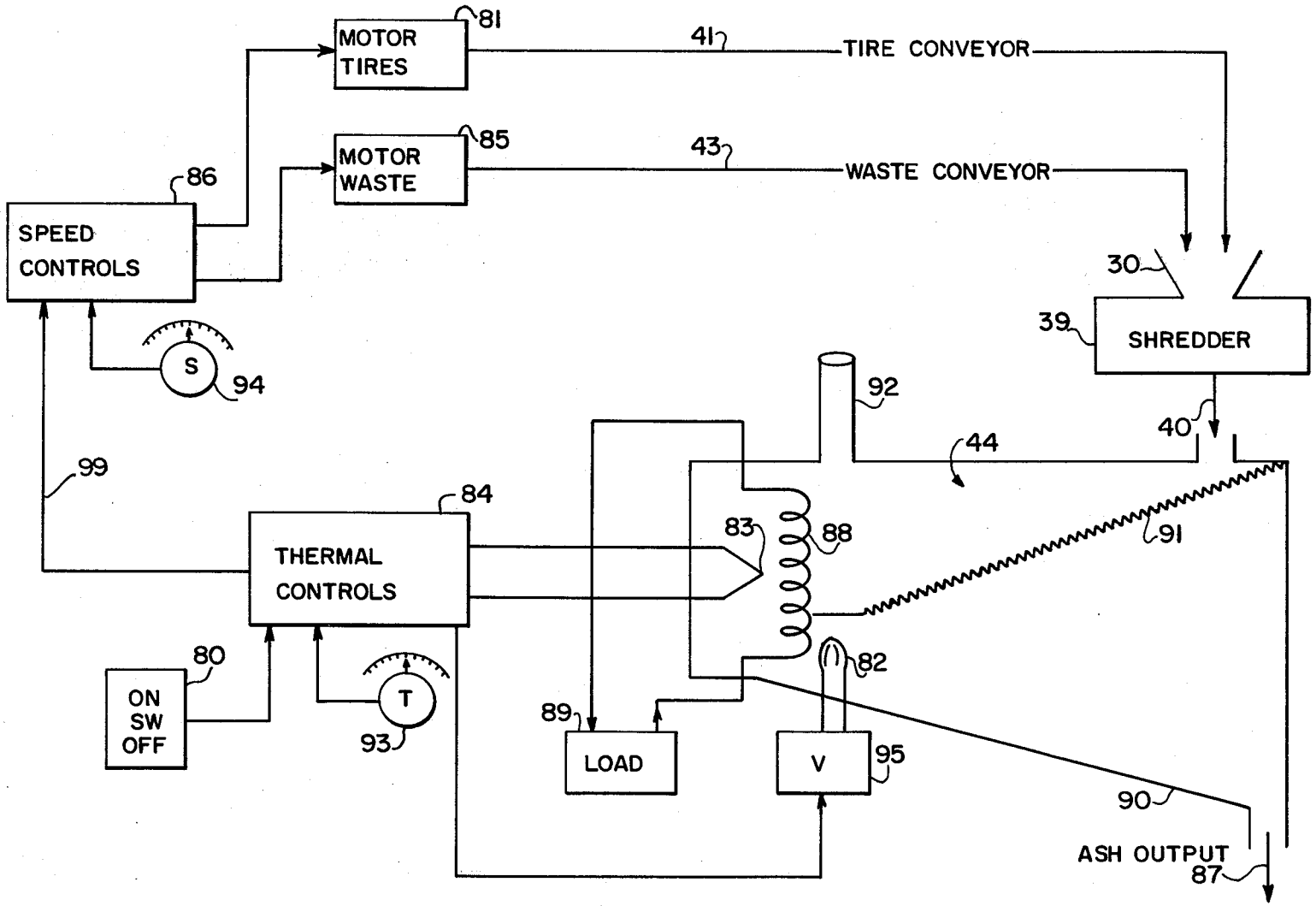
FIG. 8 is a control diagram of an incineration system.

The aforesaid equipment readily shreds and processes 30" automobile tires at a rate of 1800 per hour, as represented for example by conveyor 41 in FIGS. 5 and 8. This mixed together with primary household waste including wet garbage processed by conveyor 43 at three to four tons per hour is intermixed at the shredder hopper 30 (FIGS. 3, 4 and 8) and shredded in shredder 39 to present homogenously mixed waste and tire shreds at output chute 40.

The tire shreds have at least twice the BTU energy of coal when burned and ignite more readily. They thereby support self ignition and will evaporate any moisture contained in the shredded mixture as it proceeds through incinerator 44 without disturbing the burning process.

Initially to start the process, it is either preferable to heat the incinerator 44 to a preferred incineration temperature with a thermostatically controlled gas pilot frame or to first process and ignite the tires without intermixed waste until the incinerator reaches temperature where the track 43 carrying waste operates as a function of thermostatic control of proper temperature as shown in FIG. 8.

Thus, when the system is turned on by switch 80, the motor 81 will send tires into the shredder for ignition at the incinerator 44 by means of gas pilot 82, which can also, if desired, be controlled to help heat the incinerator 44 by means of control valve 95 until the thermocouple or like sensor 83 by way of thermal control circuits 84 at the desired temperature serve to reduce the gas to pilot flame 82 and adjust the speed of motor 85 such as by turning it on, for mixing waste with the shredded tires. Also if desired in a more complex control mode the speed control circuit 86 can be controlled as a function of operations of incinerator temperature to reduce the waste conveyor speed if the temperature is reduced thereby to produce by feedback 99 continuous optimum mix of tires and waste. As may be seen from ash outlet 87 the residue waste is easily collected and transported in its most compact form.

Also as noted by boiler pipes 88, and heat load 89, the fuel may be used to generate steam or perform work in addition to the incineration in other ways.

Thus, this invention provides a process which intermixes tires and waste in predetermined proportions such that by shredding together, a self-fueled incineration product is provided, which can either be used to self incinerate and compact size or to generate heat for a thermal system. The mixture when ignited will continue to burn when continuously fed at a high rate of speed such as set forth in the foregoing example.

While the incinerator may take several forms, the embodiment shown basically comprises a slanted bottom 90 to aid removal of ash at 87, when the incinerated materials fall through slanted grate 91, which permits materials entering the incinerator 44 at 40 to travel downward toward the pilot flame 82 for ignition in the vicinity of boiler pipes 88 and flue 92.

With the control system above described, the thermal control temperature maintained in incinerator 44 may be set at a desired temperature by manually selected control 93. Also the nominal speed control 94 can be used manually to set the waste conveyance speed desired at full temperature. Thus, for example, the temperature setting and the waste conveyance speed can be manipulated for optimum reduction of all waste at a given flow speed to its most compact ash form. Alternatively, if it is preferred to use the mixture more efficiently as a fuel source the temperature and speed controls can produce proper heat for boiler pipes 88 at the minimum acceptable flow for operating the load 89, all of which is conveniently and automatically done with very simple control means.

Therefore, having set forth the particular construction and operational features of improved waste disposal systems, processes and apparatus, those novel features believed representative of the spirit and nature of the invention are set forth with particularity in the appended claims.

What is claimed is:

1. The process of reducing the volume to ash and disposal of bulk household or industrial waste garbage and trash including the steps of shredding simultaneously a mixture of rubber tires and diverse kinds of combustible materials, and incinerating said shredded mixture to convert the bulk waste to ash.

2. The process defined in claim 1 wherein the diverse kinds of materials comprise damp waste of a class including prime garbage including the step of feeding the tires and materials separately into a shredder in predetermined proportions.

3. The process defined in claim 1 including the step of shredding said mixture in a series of at least two successive stages of shredders respectively shredding the materials into smaller shreds before incineration.

4. The process defined in claim 1 including the steps of shredding said mixture at a collection site and transporting the shredded materials to a remote location as compacted waste for the incineration step.

5. The process defined in claim 1 including the additional step of deriving heat energy from the incinerating of said shredded mixture for performing work in addition to incineration.

6. The process of waste disposal including the steps of intermixing tires and waste in a predetermined ratio, shredding said mixture, and controlling proportions of tire shreds intermixed with the waste thereby to produce a self burning mixture thereof upon ignition.

7. The process defined in claim 6 including continuous feed of said shredded mixture into an incinerator with said proportion of tire shreds being sufficient to reduce the entire mixture to ash.

8. The process defined in claim 6 including continuous feed of said shredded mixture as a fuel into a thermal system operating a thermally actuated load.

* * * * *